US008973412B2

(12) United States Patent
Theen-Vodegel

(10) Patent No.: US 8,973,412 B2
(45) Date of Patent: Mar. 10, 2015

(54) PLASTIC LIQUOR CONTAINER FOR A WASHING MACHINE OR A CLOTHES DRYER, AND METHOD FOR THE PRODUCTION OF A LIQUOR CONTAINER

(75) Inventor: Cornelius Theen-Vodegel, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1289 days.

(21) Appl. No.: 12/746,771

(22) PCT Filed: Nov. 21, 2008

(86) PCT No.: PCT/EP2008/065978

§ 371 (c)(1),
(2), (4) Date: Jun. 8, 2010

(87) PCT Pub. No.: WO2009/080421

PCT Pub. Date: Jul. 2, 2009

(65) Prior Publication Data

US 2010/0263224 A1 Oct. 21, 2010

(30) Foreign Application Priority Data

Dec. 20, 2007 (DE) ..... 10 2007 061 526

(51) Int. Cl.
*D06F 37/00* (2006.01)
*D06F 37/26* (2006.01)

(52) U.S. Cl.
CPC ..... *D06F 37/269* (2013.01); *D06F 37/262* (2013.01); *D06F 37/264* (2013.01)
USPC ..... 68/3 R; 264/255

(58) Field of Classification Search
CPC .... D06F 37/262; D06F 37/264; D06F 37/269
USPC ..... 68/3 R, 12.01
See application file for complete search history.

(56) References Cited

U.S. PATENT DOCUMENTS

| | | | | |
|---|---|---|---|---|
| 5,373,715 | A | 12/1994 | Sharp et al. | |
| 2004/0123633 | A1 * | 7/2004 | Jo | 68/23 R |
| 2005/0028568 | A1 | 2/2005 | Koch et al. | |
| 2006/0125150 | A1 | 6/2006 | Gomez Caudevilla et al. | |
| 2007/0062225 | A1 * | 3/2007 | Fechtel et al. | 68/3 R |
| 2007/0068199 | A1 | 3/2007 | Dahlmann et al. | |

FOREIGN PATENT DOCUMENTS

| | | | |
|---|---|---|---|
| EP | 1528136 | A2 | 5/2005 |

* cited by examiner

*Primary Examiner* — David Cormier
(74) *Attorney, Agent, or Firm* — Nixon & Vanderhye P.C.

(57) ABSTRACT

A plastic liquor container for a washing machine, the plastic liquor container including a laundry drum with a shaft journal and a rear wall that is made of at least two plastic components of different strengths. The rear wall has reinforced regions and a bearing receptacle for the shaft journal of the laundry drum, and the bearing receptacle is made of a high-strength material. The rear wall is manufactured as a single piece by injecting the at least two plastic components into an injection molding mold with a time offset. The reinforced regions of the rear wall are structured as a sandwich component having an inner edge layer and an outer edge layer. The inner edge layer and the outer edge layer of the sandwich component are made of high-strength plastic and enclose a region made of plastic that is less strong than the high-strength plastic.

17 Claims, 1 Drawing Sheet

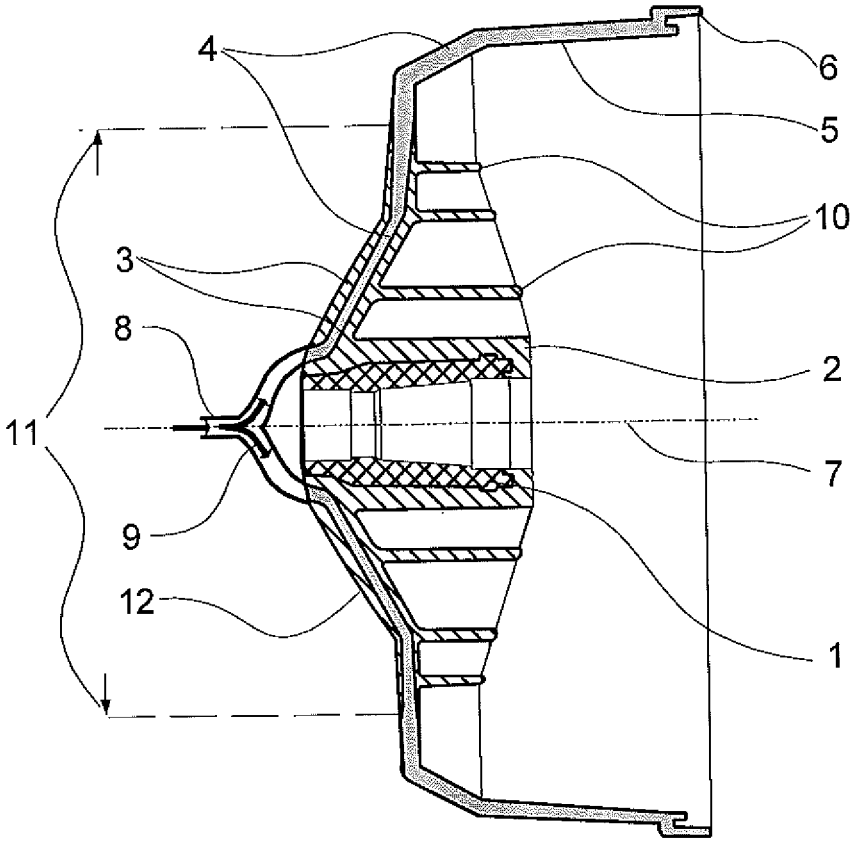
4
6
5
10
3
8
2
11
7
9
12
1

PLASTIC LIQUOR CONTAINER FOR A WASHING MACHINE OR A CLOTHES DRYER, AND METHOD FOR THE PRODUCTION OF A LIQUOR CONTAINER

This application is a U.S. National Phase of International Application No. PCT/EP08/65978, filed Nov. 21, 2008, which designates the U.S. and claims priority to German Application No. 102007061526.6, filed Dec. 20, 2007, the entire contents of each are hereby incorporated by reference.

BACKGROUND OF THE INVENTION

The invention relates to a washing machine or a washer-dryer having a plastic liquor container, essentially consisting of two plastic components. In the following reference is only made to washing machines without hereby wishing to restrict the application of the invention also to washer-dryers.

The invention is suitable in particular for use with front-loading washing machines. Such washing machines, known as front loaders, are characterized in that the laundry drum that can rotate in the liquor container has an essentially horizontal orientation and is supported on one side by way of a rotating pin. To support the rotating pin, the rear wall of the liquor container has a bearing receptacle disposed in its center. The rotating pin is connected to a motor directly or by way of a pulley, said motor driving the laundry drum from the outside.

The fact that the drum is supported on one side means that the requirements relating to mechanical strength are particularly stringent in the abovementioned front loaders. Very high rotational and bending forces occur in particular during spinning as a function of the speed of the laundry drum and the loading of the drum. The forces transmitted in the process from the laundry drum, which is supported on one side, by way of the bearing receptacle of the rotating pin to the liquor container subject the rear wall in the region of the bearing receptacle to the greatest stress. The attacking forces have to be absorbed by the bearing receptacle and transmitted or distributed to a significant extent to the outer regions of the rear wall.

The liquor container has to be structurally designed so that all the regions of the rear wall have an adequate mechanical strength in respect of the specific stresses. Since the mechanical strain on the rear wall of the liquor container is at its greatest in the region of the bearing receptacle and decreases from the bearing receptacle by way of the end side wall toward the container jacket, from the point of view of economical production of the liquor container, it must be ensured that the individual regions of the liquor container rear wall are not excessively dimensioned. Material usage should be kept to what is functionally necessary for each liquor container.

In addition to liquor containers, the rear wall of which is reinforced by means of a metal bearing bracket (e.g. EP 1 528 136 A2), liquor containers in which a high-strength plastic are used to reinforce the rear walls are also known from the prior art.

The technology for producing the liquor container is standardized by dispensing with a metal bearing bracket. It is possible to reduce technical and organizational production outlay as well as economic production outlay considerably. It is also possible to avoid the risks that arise with a liquor container with a metal bearing bracket that materials are used that have very different physical characteristics. The different expansion coefficients and thermal conductivities of the metal and plastic mean that after injection has taken place around the bearing bracket in the liquor container rear wall, considerable tensions can occur, which can result in cracks in the plastic.

WO 2004/042133 should be mentioned as an example of a liquor container produced using two different plastic components. The liquor container described therein has a metal bearing dish with a body made of a strong, high-quality plastic. The plastic is injected according to known methods. The metal bearing dish and the plastic body form a structural unit. In a following method step the liquor container jacket is injected on. A less strong plastic that is much cheaper is used for the container jacket.

The disadvantage of the structure is that the stabilizing effect of the additional body with the strong plastic is restricted to the region of the bearing receptacle. The strong plastic has no or little effect on the stability of the rear wall of the liquor container.

Plastic liquor containers are also known, in which an additional stabilizing component is used to stabilize the end side wall from the outside, being made of a stronger and better quality plastic than that of the liquor container jacket. The stabilizing component and the end side wall of the liquor container are injection molded parts, which are welded together. Reinforcing ribs are molded into the known stabilizing component and/or into the end side wall, said ribs being shaped to correspond to one another, so that the backs of the reinforcing ribs adjoin the opposing surface along their extension without any gaps.

The last described liquor container is characterized by a high level of strength. The number of molded in reinforcing ribs and their different dimensions, as well as the option of electing to mold reinforcing ribs into the stabilizing component or end side wall mean that with effective material deployment liquor containers can be produced the strength of which is based on the specific stresses during operation of the washing machine.

The disadvantage of the last described liquor container is that the parts produced by injection molding have to be joined together in a subsequent process, with the parts being positioned against one another in a first method step and then being welded. The welding methods are known and are easily mastered. Manufacture of the liquor container therefore has the major disadvantage that in addition to injection molding a second technology has to be employed, which requires additional equipment.

BRIEF SUMMARY OF THE INVENTION

The object of the invention is to create a liquor container made of two different plastics with further improved strength characteristics compared with the prior art, as well as a method for producing such a liquor container. It is in particular the object of the invention to propose a liquor container, for the production of which it is possible to reduce the technological outlay and the costs of materials used to a minimum.

According to the invention the object is achieved by the features of the invention.

The inventive liquor container is characterized in that it is produced as a single piece consisting of at least two plastic components and has the mechanical strength required for all stresses that may occur in every region, without being excessively dimensioned. The particular advantage of the invention is that only one technology is used to produce the liquor container and this is injection molding. A further important advantage is that the costs of the plastic materials used can be reduced to a minimum.

The inventively embodied liquor container is configured at least in regions as a sandwich component, consisting of two outer layers made of a high-strength plastic and an intermediate layer made of a cheap and less strong plastic. The proposed structure has proved to be particularly stable and particularly cost-effective with regard to the costs of materials used.

Tests have shown that glass fiber reinforced polypropylene is particularly highly suitable as a material for regions with a particularly high stress level. Talc reinforced polypropylene in particular is a favorable variant as an intermediate material and as a material for the edge and jacket region, in particular for cost reasons. Both plastic components can be processed readily by injection molding with no problems occurring at the transition points.

A liquor container with the proposed structure can always be designed so that it can withstand the high level of mechanical strain that is transmitted from the laundry drum to the rear wall of the liquor container during the operation of washing machines. Tailored dimensioning of the high-strength layers and their extension from the bearing receptacle radially outward in particular allows liquor containers to be produced in any size and of any type, their strength being based precisely on the different stresses in the regions during operation of the washing machine.

The particular advantage of the inventive liquor container is that the liquor container rear wall is produced in its entirety in just one injection molding operation. Injection molding technology is known and can be mastered easily. The different plastic components are supplied one after the other during the process, with the stronger plastic component being injected first. The sandwich structure results from the production process. The effect is utilized that the plastic cools faster on the walls of the injection molding mold, loses its capacity to flow in the process and adheres to the walls of the injection mold. During the subsequent introduction of the less strong second plastic component into the injection molding mold the plastic of the first component that is still able to flow is pushed out of the inner region and pressed radially outward. The region between the plastic that has hardened on the mold is filled by the less strong and cheaper plastic.

By controlling the injection molding process it is possible to vary the radial extension of the regions in the sandwich structure and the wall thicknesses of the outer layers made of high-strength material continuously. The quantity of plastic injected per unit of time and the time delay before injecting the second plastic component are controlled during the process.

BRIEF DESCRIPTION OF THE DRAWINGS

The inventive liquor container and the method for its production are described in more detail below with reference by way of example to the accompanying drawings, in which the FIGURE shows a sectional diagram of a liquor container rear wall.

DETAILED DESCRIPTION OF EXEMPLARY EMBODIMENTS OF THE PRESENT INVENTION

The FIGURE shows a sectional diagram vertically through the drum axis 7 of an embodiment of the inventive rear wall of the liquor container produced as a single piece in an injection molding method.

The liquor container rear wall comprises the rear end side wall of the liquor container with the bearing receptacle for the drum shaft, a transition region 5 to the cylindrical liquor container jacket and a receptacle 6 for joining and screwing the liquor container jacket, as well as molded in reinforcing ribs 10 with circle symmetry. The radial and meandering reinforcing ribs also present are not shown to simplify the drawing.

The thickness of the rear wall 12 and the height of the ribs decrease, as shown in the drawing, from the bearing receptacle 2 to the container jacket 5. The rear wall region characterizing the present invention in the sandwich structure 11 is configured as circular in the example and is disposed symmetrically in relation to the drum axis 7. In the drawing the regions made of high-strength plastic 3 are shown hatched, with the regions made of less strong plastic 4 being identifiable from their gray color.

The liquor container rear wall is produced in its entirety in one injection molding operation, with a stronger and better quality plastic being injected in a first work segment and a second, less strong plastic component following. By controlling the injection molding it is possible to define precisely the radial extension of the regions in the sandwich structure 11 and the thickness of the wall layer made of high-strength plastic. In the example the material thicknesses of the edge layers made of high-strength plastic 3 decrease continuously in an outward direction.

The different material thickness that decreases in a radially outward manner is a means of designing the individual regions of the liquor container so that their stability can be designed to precisely the required degree without excessive dimensioning.

In addition to the advantages described above, application of the inventive method allows liquor containers of different strengths to be produced using the same injection molding molds. In particular liquor containers of the desired strength can be produced using already available injection molding molds just by controlling the injection molding operation accordingly.

The circular form of the region in the sandwich structure 11 shown in the example can be produced easily by supplying the plastic with an even distribution and symmetrically in relation to the drum axis 7 during injection molding. This is shown symbolically in the drawing by the arrows 9 of equal thickness indicating the flow direction.

In known embodiments the strength of the plastic liquor container is determined by way of the wall thicknesses of the rear wall 12 and the reinforcing ribs 10, by way of the use of the different material components for the reinforcing ribs 10 and the rear wall 12 and by way of the arrangement, embodiment and number of molded in reinforcing ribs 10, in particular by means of the embodiment in height and width.

By using the inventive method it is additionally possible to influence the strength of the liquor container. The stability of the liquor container can be influenced by way of the extension of the region made of high-strength plastic 11 and by way of the wall thicknesses of the edge layers 3 in this region 11. Both parameters, the radial extension and the layer thicknesses, can be dimensioned by corresponding control of the manufacturing process, i.e. by controlling the injection molding operation.

During the injection molding operation the quantity of plastic components supplied per unit of time and the time delay and speed at which the quantity of the second plastic component is injected are controlled. Both are effected simply by controlling the plastic delivery pistons. Since both the quantity of the plastic components supplied per unit of time and the time delay before injection of the second plastic component can be adjusted infinitely, both parameters determining the strength of the sandwich region can vary in any manner, in other words can change continuously in the possible setting range predetermined by the mold.

Such advantageous control of the manufacturing process allows a liquor container for example of identical size and structure to be tailored simply to increased stresses using the same injection molding mold. This may be necessary for example if the spin speed is increased for a type series. The further advantage of such control is that consumption of the high-strength plastic can be optimized in respect of manufacturing costs at the same time.

LIST OF REFERENCE CHARACTERS

1 Bearing receptacle
2 Region of bearing receptacle
3 Region made of high-strength plastic
4 Region made of less strong plastic
5 Jacket surface
6 Molding
7 Axis of laundry drum
8 Fill connection
9 Flow direction
10 Reinforcing ribs
11 Sandwich region
12 Rear wall

The invention claimed is:

1. A plastic liquor container for a washing machine, the plastic liquor container comprising:

a rear wall made of at least two plastic components having different strengths, the rear wall having reinforced regions and a bearing receptacle for a shaft journal of a laundry drum, the bearing receptacle being made of a high-strength material; wherein the rear wall is manufactured as a single piece by injecting the at least two plastic components into an injection molding mold with a time offset;

the reinforced regions of the rear wall are structured as a sandwich component having an inner edge layer and an outer edge layer;

the inner edge layer and the outer edge layer of the sandwich component are made of respective high-strength plastic and enclose a region made of plastic that is less strong than the respective high-strength plastic; and the plastic that is less strong extends radially away from the bearing receptacle farther than the high-strength plastic.

2. The plastic liquor container of claim 1, further comprising a drum jacket, wherein, in a region of the bearing receptacle, a proportion of the high-strength plastic is of a predetermined amount, and wherein the proportion decreases outward toward the drum jacket.

3. The plastic liquor container of claim 1, wherein the inner edge layer forms a front-most outer surface of the rear wall and the outer edge layer forms a rear-most outer surface of the rear wall.

4. The plastic liquor container of claim 1, wherein the high-strength material includes reinforcement from glass fibers that are injected into the rear wall.

5. The plastic liquor container of claim 1, wherein the inner edge layer and the outer edge layer decrease in thickness in a radially outward direction.

6. A method for producing a plastic liquor container for a washing machine, the plastic liquor container having a rear wall made of at least two plastic components having different strengths, the rear wall having a bearing receptacle for a shaft journal of a laundry drum, wherein the bearing receptacle is made of a high-strength material, the method comprising:

manufacturing the rear wall as a single piece by injecting, with a time offset, the at least two different plastic components into an injection molding mold for producing the plastic liquor container; wherein a high-strength plastic component is introduced at a start of injection;

a plastic component that is less strong than the high-strength plastic component is introduced after the high-strength plastic component is introduced and thus forming a sandwich component having an inner edge layer and an outer edge layer where the high-strength plastic encloses the plastic that is less strong; and the plastic that is less strong is extended radially away from the bearing receptacle farther than the high-strength plastic.

7. The method of claim 6, wherein respective quantities of the high-strength plastic component and the plastic component that is less strong than the high-strength plastic component that are introduced per unit of time can be controlled.

8. The method of claim 6, wherein respective quantities of the high-strength plastic component and the plastic component that is less strong than the high-strength plastic component are injected with an even distribution and symmetrically in relation to a drum axis.

9. A plastic liquor container for a washing machine, the plastic liquor container comprising:

a rear wall with reinforced regions; and a bearing receptacle for a shaft journal of a laundry drum, wherein the rear wall comprises a rear outer-most layer, a front outer-most layer and an intermediate layer between the rear outer-most layer and the front outer-most layer, the rear outer-most layer and the front outer-most layer are made from a first plastic injection molded material, the intermediate layer is made from a second plastic injection molded material, the first plastic injection molded material is stronger than the second plastic injection molded material, and the second plastic injection molded material extends radially away from the bearing receptacle farther than the first plastic injection molded material.

10. The plastic liquor container according to claim 9, wherein the rear outer-most layer, the front outer-most layer and the intermediate layer are unified in a single piece by an injection molding process.

11. The plastic liquor container according to claim 9, wherein the intermediate layer is injected between the rear outer-most layer and the front outer-most layer.

12. The plastic liquor container of claim 9, further comprising a drum jacket, wherein the drum jacket is formed from the second plastic injection molded material and continuously with the intermediate layer.

13. The plastic liquor container of claim 9, wherein an axial thickness of the rear wall in a region nearest the bearing receptacle comprises the first plastic injection molded material but not the second plastic injection molded material, and the axial thickness outside of a predetermined radius from the bearing receptacle comprises the second plastic injection molded material but not the first plastic injection molded material.

14. The plastic liquor container of claim 9, wherein the first plastic injection molded material includes glass fiber reinforcement.

15. The plastic liquor container of claim 9, wherein the second plastic injection molded material includes talc reinforcement.

16. The plastic liquor container of claim 9, wherein the second plastic injection molded material is injected with a time offset with respect to the first plastic injection molded material.

17. The plastic liquor container of claim 9, wherein the rear outer-most layer and the front outer-most layer decrease in thickness in a radially outward direction.

* * * * *